United States Patent [19]

Hazelett et al.

[11] 4,403,380

[45] Sep. 13, 1983

[54] CASKET BED

[75] Inventors: David A. Hazelett; Charles B. Shaw, both of Lynn; Paul W. McCombs, Connersville, all of Ind.

[73] Assignee: Astral Industries, Inc., Lynn, Ind.

[21] Appl. No.: 348,094

[22] Filed: Feb. 11, 1982

[51] Int. Cl.[3] ..... A61G 17/00

[52] U.S. Cl. ..... 27/12

[58] Field of Search ..... 27/12, 2; 5/175, 181, 5/184, 185, 202

[56] References Cited

U.S. PATENT DOCUMENTS

| | | | |
|---|---|---|---|
| 516,660 | 3/1894 | Schroter | 5/184 |
| 695,752 | 3/1902 | Moehle | 5/184 X |
| 890,407 | 6/1908 | Colles | 5/184 |
| 933,810 | 9/1909 | Wokurka | 5/184 |
| 2,670,173 | 3/1954 | Hillenbrand et al. | 27/12 |
| 2,839,814 | 6/1958 | Harter | 27/12 |
| 2,848,781 | 8/1958 | Slaughter, Jr. et al. | 27/12 |
| 2,888,732 | 6/1959 | Nelson | 27/12 |
| 3,041,704 | 7/1962 | Gruber | 27/12 |
| 3,065,516 | 11/1962 | Dower | 27/12 |
| 3,145,445 | 8/1964 | Hegman et al. | 27/12 |
| 3,184,819 | 5/1965 | White | 27/12 |
| 3,300,829 | 1/1967 | Hegman et al. | 27/12 |
| 3,539,142 | 11/1970 | Morand | 248/221 |
| 3,568,275 | 3/1971 | Carson, Jr. | 27/12 |
| 3,653,104 | 4/1972 | Nelson | 27/12 |
| 3,692,267 | 9/1972 | Kronas | 248/288 |
| 4,070,737 | 1/1978 | Peterson | 27/12 |

*Primary Examiner*—John D. Yasko

*Attorney, Agent, or Firm*—Barnes & Thornburg

[57] ABSTRACT

An inexpensive, vertically movable, casket bed consists of two, preferably U-shaped, frame ends having threaded apertures directly engaging a vertical adjustment screw. The frame ends include slots preferably with a protruding edge for receiving the ends of side members, the side members having notches on their lower extremities which lockingly engage with the frame ends. At least one notch on each side member is shaped to permit longitudinal variation in the distance between frame ends. Spring-biased, longitudinal straps are supported by cross members contacting the side members. The adjustment screw is supported in a cup-shaped base support and retained in position by tangs holding a cap fixed to the screw in the smaller portion of a keyhole-shaped slot in an upper support plate fixed to the casket end.

14 Claims, 7 Drawing Figures

CASKET BED

The present invention relates generally to burial caskets and in particular to vertically adjustable casket beds within the burial casket for supporting a body at an adjustable height and attitude.

In the prior art, various beds have been designed which permit the vertical adjustment of position with a body within a casket so as to accommodate individuals of different size and to permit easy viewing of the deceased by friends and relatives at an appropriate ceremony. The mechanisms have varied considerably in complexity, cost, and performance. Two examples of rather inexpensive mechanisms are disclosed in U.S. Pat. Nos. 3,145,445 and 3,539,142. In general, the simpler, lower cost mechanisms have been difficult to operate and somewhat unreliable. On the other hand, mechanisms having additional features to insure reliability and enhance performance have necessarily been rather expensive, thereby limiting their marketability to inclusion only in high-priced caskets. The higher priced caskets have typically included a vertically positioned, threaded rod or screw at each end of the casket on which a bracket is carried. The underlying bed frame for the casket bed is then secured to the bracket by various means to permit elevation of the bed by rotation of the vertical threaded rod. Particularly relevant examples in the prior art are shown in U.S. Pat. Nos. 3,041,704; 3,692,267; and 4,070,737.

It is an object of the present invention to employ the vertical adjustability feature provided by a vertically oriented, threaded rod in connection with a low-cost casket bed. It is a further object of the present invention to provide a highly reliable mechanism which is easily assembled with a minimum of parts.

These and other objects of the present invention are achieved by mounting a pair of vertically extending, threaded rods within a casket, one rod situated at each end of the casket. A pair of laterally extending frame ends are directly engaged on the threaded rod by threaded apertures passing directly therethrough. Each frame end has two additional apertures for receiving side members. A pair of longitudinally extending side members are lockingly received in the additional apertures in each frame end with at least one end of each longitudinally extending side member including a feature permitting longitudinal variation of the distance between the pair of frame ends. The side members include, on a lower surface thereof, a notch adjacent each end of the side member for engaging the frame ends with at least one of the notches on each side members being longitudinally enlarged to permit the movement of the side member with respect to the associated end member without disengagement therefrom.

The direct engagement of the frame end on the vertically extending, threaded rods significantly reduces the cost of the casket bed by eliminating the presence of any intermediate brackets or supports such as were commonly found in the prior art. The locking engagement of the side members into the frame ends permits very easy assembly of the apparatus without the necessity of fasteners of any type, thereby significantly lowering the manufacturing time required to produce a casket bed of satisfactory performance. Various other features and their associated advantages will be apparent to those skilled in the art by consideration of the accompanying figures illustrating a preferred embodiment exemplifying the best mode of the invention as presently perceived.

Figure 1:
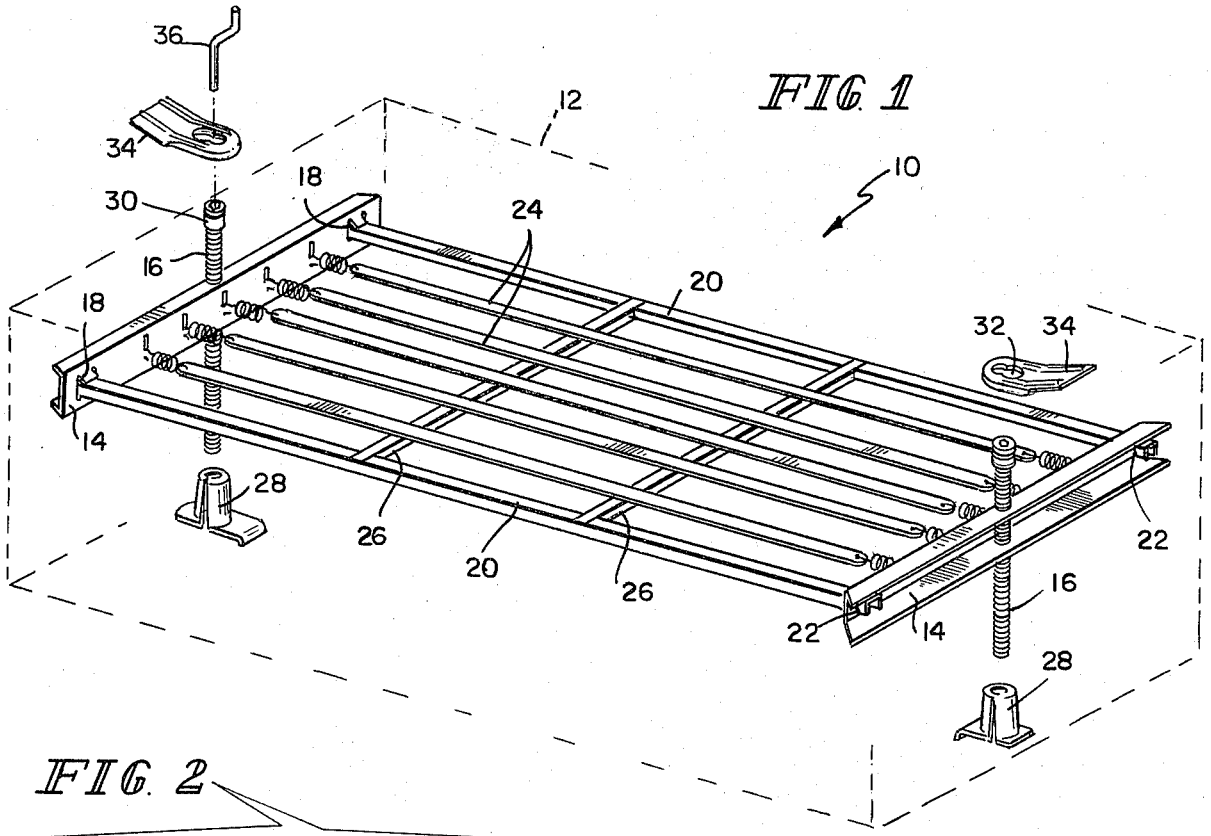
FIG. 1 is an exploded perspective view of the invention within the phantom figure of a casket.

A casket bed 10 is situated in casket 12, the casket bed comprising two preferably U-shaped frame ends 14 having threaded apertures therein which directly engage vertical adjustment screws 16. The frame ends 14 include slots 18 on both ends of each frame end for receiving the ends of side members 20. The side members 20 have notches 22 on their lower extremities which lockingly engage with the frame ends 14. Spring-biased, longitudinal straps 24 are supported by cross members 26 contacting side members 20. The adjustment screw 16 is supported in a cup-shaped base support 28 and retained in position by a cap 30 fixed to each screw engaged in a keyhole slot 32 in an upper support plate 34 fixed to the casket ends. A conventional, hexagonal key 36 is employed to raise or lower either end of the bed by insertion of key 36 in cap 30 and rotating the same. This rotation causes screw 16 to rotate which, by virtue of its direct engagement of frame end 14, causes the frame end to move vertically with respect to supports 28 and 34 and, hence, casket 12.

Figure 2:
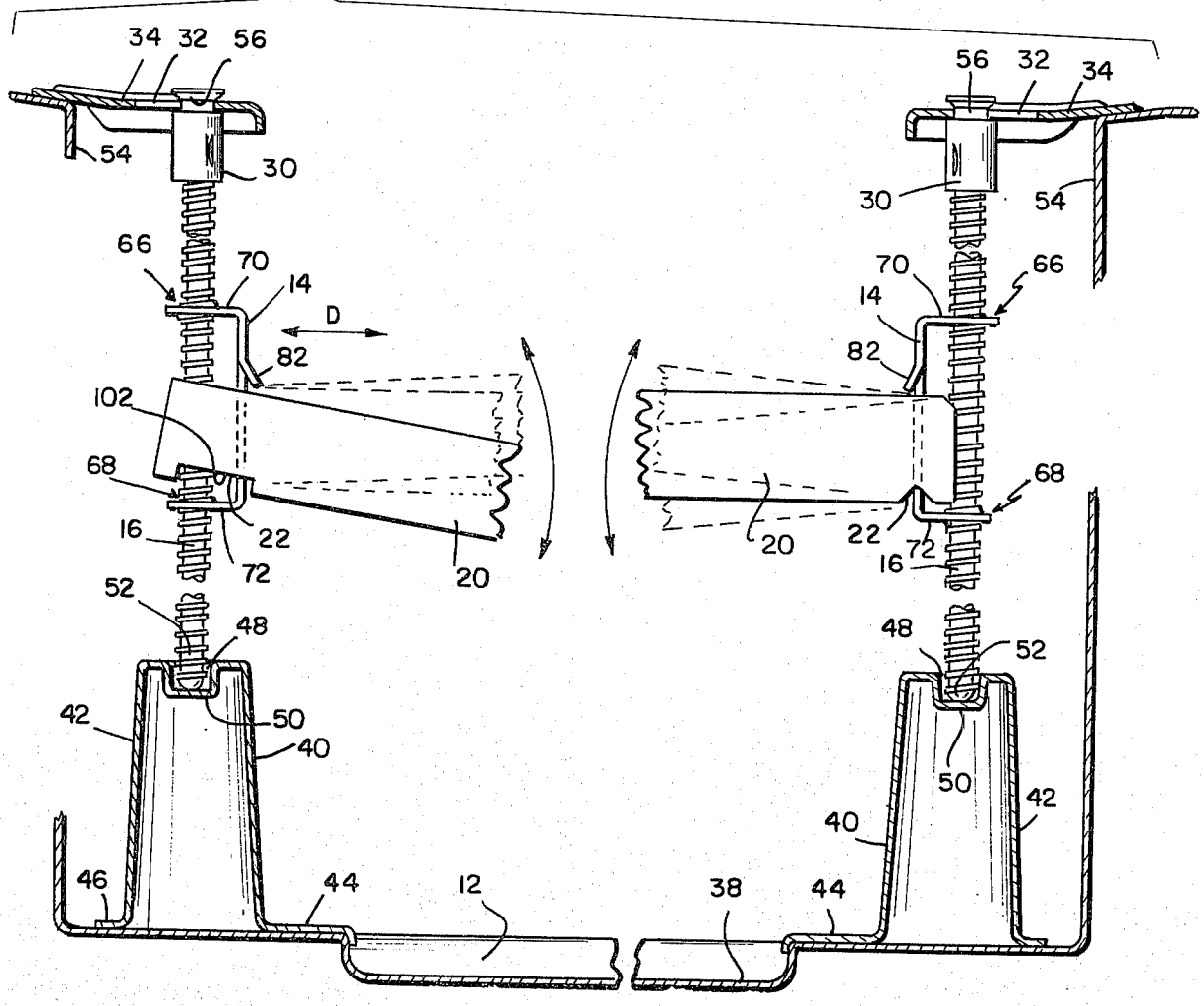
FIG. 2 is a sectional detail view of the invention installed in a casket.

As shown in FIG. 2, the casket 12 includes bottom 38 to which base supports 28 are fixed, preferably by welding. The base support comprises generally an inverted, U-shaped member having downwardly extending legs 40 and 42 with flanges 44 and 46 at the lower extremities of legs 40 and 42, respectively. A shallow, upwardly opening cup 48 is included in the bight 50 of the U-shaped base support 28, the cup receiving lower end 52 of vertical adjustment screw 16.

Figure 6:
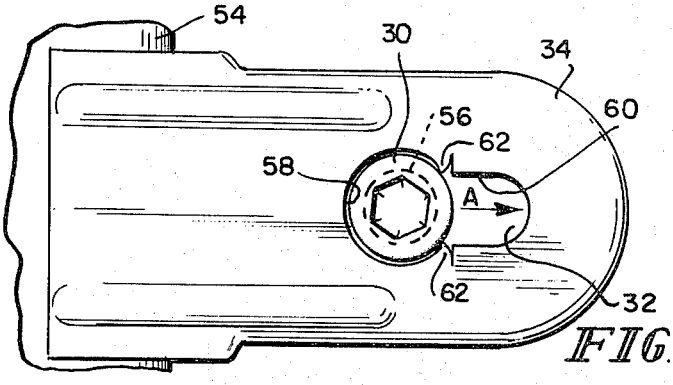
FIG. 6 is a plan view of an upper support showing the keyhole slot therein.

Upper support plates 34 are fixed to an upper portion 54 of casket 12, preferably by means of welding, and situated such that cap 30 extends part way through keyhole slot 32, the sides of a narrower portion of slot 32 engaging an annular groove 56 near the upper end of cap 30. A more detailed view appears in FIG. 6 where it will be noted that the size of cap 30 is such that it is easily received in the larger portion 58 of keyhole slot 32. After being thus received, the cap 30 is moved in the direction A to the narrower portion 60 of keyhole slot 32 past tangs 62 which curve downwardly to engage a lower surface 64 of annular groove 56, thereby preventing cap 30 from moving from the narrower portion 60 of slot 32 to the larger portion 58.

Figure 3:
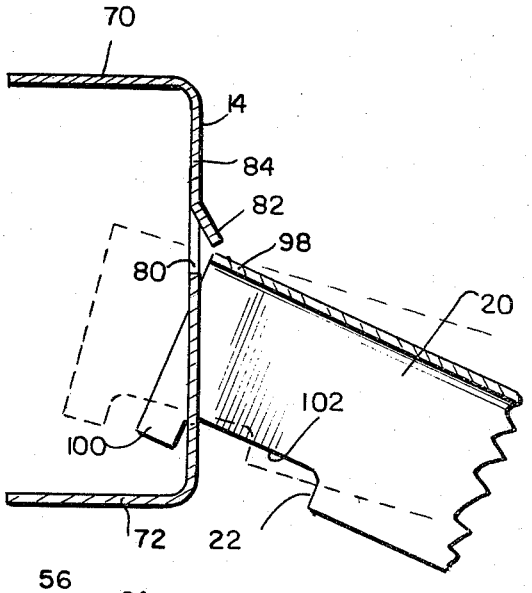
FIG. 3 is a sectional detail showing insertion of one end of a side member into an aperture in an end frame.
Figure 4:
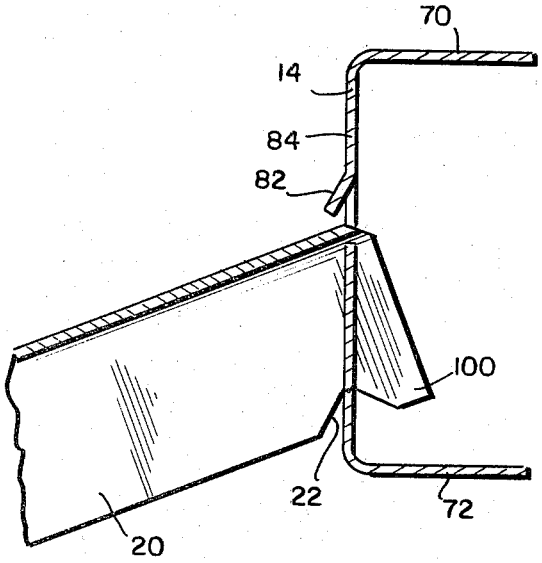
FIG. 4 is another detail view showing the insertion of an end of a side member into an aperture in an end frame.
Figure 5:
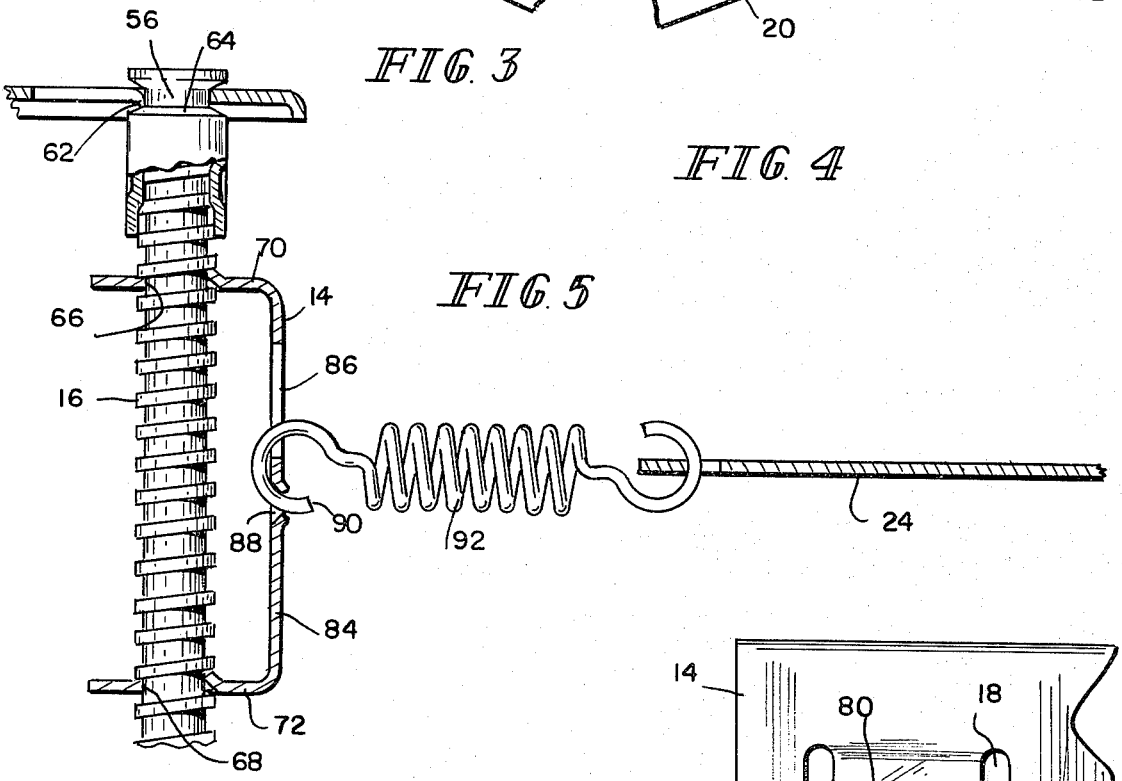
FIG. 5 is a detail showing the biasing interconnection between an end frame and a longitudinal strap.
Figure 7:
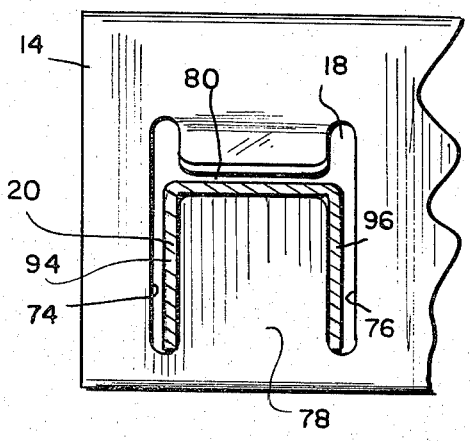
FIG. 7 is a front elevational view of one end of an end frame showing the H-shaped aperture receiving a side member shown in section.

As seen in FIGS. 2–5, the frame ends 14 are seen to be generally U-shaped with the vertical adjustment screw 16 passing directly through apertures 66 and 68 on the upper and lower legs 70 and 72, respectively, of the U-shaped frame end 14. An H-shaped aperture 18, best illustrated in FIG. 7, is provided in each end of each end member 14. The H-shaped aperture 18 may be viewed as including two lower legs 74 and 76 separated by an upwardly extending tongue 78 at the top of which is a horizontal slot 80. Above the horizontal slot 80 is an edge 82 protruding from the plane of the bight 84 of the U-shaped frame end 14, as best illustrated in FIGS. 3 and 4. Additional slots 86 are provided in the bight 84 of frame end 14 and immediately below each slot 86 is a hole 88 which is chamfered to readily receive the end 90 of spring 92 attached to longitudinal strap 24.

The side members 20 are shown to be inverted, U-shaped channels consisting of downwardly extending legs 94 and 96 joined by top plate 98. As shown in FIG. 7, the vertical dimension of legs 94 and 96 of side member 20 exceeds the vertical dimension of the lower slots 74 and 76 below the horizontal slot 80 in aperture 18. This dimensional relation achieves the desirable effect of locking the side member 20 into end frame 14 after it is once inserted. The insertion of the ends of the side member 20 into end frame 14 is illustrated in FIGS. 3 and 4 where it will be noted that it is necessary to insert the end 100 of the side member 20 to such a point that notch 22 on lower surface of edge member 20 is engaged by the lower end of slot legs 74 and 76, respectively. With both ends thus engaged, the protruding edge 82 acts to limit the upward movement of one end of a side member 20 and thus also acts to limit the downward angular displacement of the opposite end of the same side member as generally shown in phantom in FIG. 2. Thus, once the bed is installed in the casket, the side members 20 are lockingly engaged with the end members 14 such that disengagement is not possible without removal of one of the adjustment screws from its locking engagement with the upper support plate 34.

As shown in FIGS. 2–4, the slots 22 can have various cross sectional appearances; but at least one slot 102 is longitudinally enlarged to permit variation in the inter end frame distance D. This inter frame distance D will vary somewhat, particularly when one end of the bed 10 is raised to a position significantly above the other end. As. shown in FIG. 3, notch 102 is preferably rectangularly elongated so as to permit longitudinal extension of the distance between end frames 14 yet without the possibility of disengagement of the side member 20 from end frame 14.

The preferred embodiment shown in the accompanying drawings is intended to be illustrative of the invention hereafter claimed. Various variations and modifications of the various elements shown in the accompanying drawings can be effected without departing from the spirit and scope of the invention as hereafter defined.

We claim:

1. A vertically adjustable casket bed comprising:

a pair of vertically extending, threaded rods, one rod situated at each end of the casket, a pair of laterally extending frame ends, each frame end comprising a U-shaped channel member having a pair of apertures surrounding one of the vertically extending rods, one such aperture being situated in each leg of the U-shaped channel forming the frame end, at least one aperture directly engaging the threads of a corresponding rod, each frame end having two additional apertures situated in the bight of the U-shaped channel for receiving side members, each additional aperture including an edge protruding from the plane of the bight, and a pair of longitudinally extending side members, the ends of each side member being lockingly received in one of the additional apertures in each frame end, at least one end of each longitudinally extending side member including means for permitting longitudinal variation of the distance between the pair of frame ends.

2. The casket bed of claim 1 wherein each longitudinally extending side member includes on a lower surface thereof a notch adjacent each end of the side member for engaging the frame ends, at least one of the notches on each side member being longitudinally enlarged to permit movement of the side member with respect to an associated end member without disengagement therefrom.

3. The casket bed of claim 1 wherein each frame end comprises a U-shaped channel member having a pair of threaded apertures engaging one of the vertically extending rods, one such threaded aperture being situated in each leg of the U-shaped channel forming the frame end.

4. The casket bed of claim 3 wherein said two additional apertures in each frame end are situated in the bight of the U-shaped channel, and each aperture includes an edge protruding from the plane of the bight to permit the insertion of an end of a side member into locking engagement with the end member.

5. The casket bed of claim 4 wherein each of said two additional apertures in each frame end are generally H-shaped, the upper formation member defined by the H shape protruding toward the opposite frame end, thereby limiting the upward movement of the side member with respect to the frame end.

6. The casket bed of claim 5 wherein the side members each comprise a downwardly opening U-shaped member, the length of the legs of the U-shaped side member exceeding the length of the slots below the horizontal slot of the H shape forming said two additional apertures, the side members having on a lower extremity adjacent each end a notch permitting the positioning of the side member in the lower portion of the H-shaped aperture.

7. The casket bed of claim 3 further comprising a plurality of longitudinally extending, intermediate members extending substantially parallel to the side members, each intermediate member including on at least one end thereof biasing means for biasing the two frame ends toward each other.

8. The casket bed of claim 7 further comprising at least one cross member extending between the two side members below the intermediate members for supporting the intermediate members in a substantially planar configuration.

9. The casket bed of claim 1 further comprising a pair of base supports each supporting the lower end of one of the vertically extending, threaded rods, the base support comprising an inverted U-shaped member having flared ends fixed to the bottom of the casket, the bight of the U-shaped member including a cup-shaped recess for receiving the lower end of the associated threaded rod.

10. A vertically adjustable casket bed comprising:

a pair of vertically extending, threaded rods, one rod situated at each end of the casket, a pair of top supports, one for each vertically extending threaded rod, each top support comprising a cap having an annular groove fixed to the rod, and a plate fixed to an upper portion of the casket, the plate having a keyhole-shaped slot receiving the cap, the slot including tangs for maintaining the cap in the smaller portion of the keyhole-shaped slot, a pair of laterally extending frame ends, each frame end having at least one threaded aperture directly engaging the threads of a corresponding rod, each frame end having two additional apertures for receiving side members, and a pair of longitudinally extending side members, the ends of each side member being lockingly received in one of the additional apertures in each frame end, at least one end of each longitudinally extending side member including means for permitting longitudinal variation of the distance between the pair of frame ends.

11. The casket bed of claim 1 wherein each of said two additional apertures in each frame end are generally H-shaped, the upper formation member defined by the H shape protruding toward the opposite frame end, thereby limiting the upward movement of the side member with respect to the frame end.

12. The casket bed of claim 11 wherein the side members each comprise a downwardly opening U-shaped member, the length of the legs of the U-shaped side member exceeding the length of the slots below the horizontal slot of the H shape forming said two additional apertures, the side members having on a lower extremity adjacent each end a notch permitting the positioning of the side member in the lower portion of the H-shaped aperture.

13. A vertically adjustable casket bed comprising:

a pair of vertically extending, threaded rods, one rod situated at each end of the casket, a pair of laterally extending frame ends, each frame end having at least one threaded aperture directly engaging the threads of a corresponding rod, each frame end having two additional apertures for receiving side members, and a pair of longitudinally extending side members, the ends of each side member being lockingly received in one of the additional apertures in each frame end, at least one end of each longitudinally extending side member including a longitudinally enlarged notch to permit movement of the side member with respect to an associated end member without disengagement therefrom for permitting longitudinal variation of the distance between the pair of frame ends.

14. The casket bed of claim 13 wherein each of said two additional apertures in each frame end are generally H-shaped, an upper formation member defined by the H shape protruding toward the opposite frame end, thereby limiting the upward movement of the side member with respect to the frame end, the longitudinally enlarged notch engaging a lower portion of the H-shaped aperture.

* * * * *

UNITED STATES PATENT AND TRADEMARK OFFICE

CERTIFICATE OF CORRECTION

PATENT NO. : 4,403,380

DATED : September 13, 1983

INVENTOR(S) : David A. Hazelett et al

It is certified that error appears in the above-identified patent and that said Letters Patent is hereby corrected as shown below:

Column 4, line 16, delete the numeral "1" and insert the numeral --10-- therefor.

Signed and Sealed this

*Sixth* Day of *December 1983*

[SEAL]

*Attest:*

GERALD J. MOSSINGHOFF

*Attesting Officer*

*Commissioner of Patents and Trademarks*